US011761729B1

(12) United States Patent
Moore

(10) Patent No.: US 11,761,729 B1
(45) Date of Patent: Sep. 19, 2023

(54) ARCHERY TRAINER AND EXERCISE DEVICE

(71) Applicant: Myron Joe Moore, Springfield, OH (US)

(72) Inventor: Myron Joe Moore, Springfield, OH (US)

( * ) Notice: Subject to any disclaimer, the term of this patent is extended or adjusted under 35 U.S.C. 154(b) by 0 days.

(21) Appl. No.: 18/175,441

(22) Filed: Feb. 27, 2023

(51) Int. Cl.

| | |
|---|---|
| ***F41B 5/14*** | (2006.01) |
| ***A63B 21/04*** | (2006.01) |
| ***A63B 23/12*** | (2006.01) |
| ***A63B 21/055*** | (2006.01) |

(52) U.S. Cl.
CPC ..... *F41B 5/1476* (2013.01); *A63B 21/0442* (2013.01); *A63B 21/0557* (2013.01); *A63B 23/1209* (2013.01); *A63B 2214/00* (2020.08)

(58) Field of Classification Search
CPC ..... F41B 5/1476; A63B 21/0442; A63B 21/0557; A63B 23/1209; A63B 2214/00
See application file for complete search history.

(56) References Cited

U.S. PATENT DOCUMENTS 2,667,863 A * 2/1954 Styles ..... F41B 3/02 124/20.1
4,142,297 A * 3/1979 Altier ..... F41G 1/467 33/265
4,178,693 A * 12/1979 Smith ..... F41G 1/467 33/265
4,279,601 A * 7/1981 Cobelli ..... A63B 69/00 482/122
4,609,191 A * 9/1986 Remme ..... A63B 21/0552 482/122
4,757,614 A * 7/1988 Kudlacek ..... F41G 1/467 124/87
4,887,584 A * 12/1989 Carella ..... A63B 21/0004 124/90
4,982,503 A * 1/1991 Land ..... F41G 1/467 42/137
5,052,365 A * 10/1991 Carella ..... F41B 5/14 124/90
5,163,413 A * 11/1992 Carella ..... F41B 5/1476 124/90
5,201,123 A * 4/1993 Booe ..... F41G 1/467 42/132
5,285,767 A * 2/1994 Padilla ..... F41B 5/1426 124/80
5,465,491 A * 11/1995 Thell ..... F41G 1/467 33/265
5,535,731 A * 7/1996 Webster ..... F41B 5/1426 124/89
5,592,928 A * 1/1997 Frasier ..... F41B 5/1476 482/122
5,592,929 A 1/1997 Frasier
5,695,437 A * 12/1997 Olschansky ..... A63B 21/4015 482/125

(Continued)

*Primary Examiner* — Andrew S Lo
(74) *Attorney, Agent, or Firm* — R. William Graham

(57) ABSTRACT

An archery trainer and exercise device has a gripping handle having a central grip surface, a relatively inelastic member connected to the gripping handle and a force resistance elastic member connected at one end to the inelastic member and another end connected to a string attachment. A sight extends from a top surface of the gripping handle and a weight extends from a bottom surface of the gripping handle.

16 Claims, 3 Drawing Sheets

(56) References Cited

U.S. PATENT DOCUMENTS

| | | | | | |
|---|---|---|---|---|---|
| 5,720,700 | A * | 2/1998 | Buoni | A63B 21/0552 | 482/44 |
| 5,735,053 | A * | 4/1998 | McGunigal | F41G 1/467 | 124/87 |
| 6,802,129 | B1 * | 10/2004 | Wirth | F41G 1/467 | 124/87 |
| D617,856 | S * | 6/2010 | Brinser | F41G 1/467 | D21/692 |
| 8,079,942 | B2 * | 12/2011 | Anderson | A63B 21/4015 | 482/121 |
| 2002/0148125 | A1 * | 10/2002 | Shepherd | F41G 1/467 | 124/87 |
| 2011/0028288 | A1 * | 2/2011 | Anderson | A63B 21/0552 | 482/121 |
| 2014/0352679 | A1 * | 12/2014 | Torbett | F41B 5/1453 | 124/89 |
| 2015/0184973 | A1 * | 7/2015 | Martens | F41B 5/00 | 124/88 |
| 2015/0300769 | A1 * | 10/2015 | Heisser | F41B 5/1476 | 408/1 R |
| 2018/0333617 | A1 * | 11/2018 | Appleton | A63F 7/2481 | |
| 2021/0302120 | A1 * | 9/2021 | Avery | A63B 23/03508 | |
| 2022/0057164 | A1 * | 2/2022 | Avery | A63B 23/1209 | |

* cited by examiner

ARCHERY TRAINER AND EXERCISE DEVICE

BACKGROUND OF INVENTION

Field of Invention

This invention relates to an improved archery trainer and exercise device and in particular, is related to a device in which an archer can train to improve the sighting and handling of a bow and in strengthening the muscles necessary for improved archery performance without the use of an actual bow.

Prior Art

As is well known by archery professionals, to become a proficient archer one would shoot a hundred shots or more a day to maintain top form. In the past, to train an archery one required that one actually use a bow in order to learn the proper grip, hand position and sighting. This training usually took place at an archery range.

However, due to a limited number of archery ranges available, alternative devices have been developed to enable one to practice without the need of a bow and arrow. These practice aids exist so archery practice can be conducted in virtually any environment, such as in the home.

While the prior aids provide some usefulness, there is a need to improve such aids. Such training aid devices commonly employ some sort of elastic member connected to a handle which can be pulled back.

However, it is desirable to have a device that simulates the tension of a bow or more when drawn back while allowing aiming at some distant target, and being able to use the archer's actual release device while holding the shot just as one would on the archery range with an actual bow and arrow. A further problem is that all the particular muscles are required to shoot a bow are not developed to the point to provide sufficient strength and repetition to pull back the archery string and hold it steady during sighting as required for accurate performance. Progress in developing and maintaining these skills is therefore slowed by one's lack of strength in the particular muscles required for archery.

There remains a need for an improved archery training device which overcomes deficiencies of prior devices. The instant invention provides solutions to overcome the problems in art.

SUMMARY OF THE INVENTION

It is an object of the invention to improve archery training.

A further object is to provide an archery trainer in which one can practice proper upper body position for accurate shooting.

It is a further object to provide an archery trainer which will strengthen the muscles of the archer particularly suited for archery.

Another object is to provide an archery trainer with adjustable physical bow weight.

Still another object is to provide an archery trainer with adjustable draw weight.

Yet another object is to provide an archery trainer which develops bow shooting muscles.

Another object is to provide an archery trainer which aids muscle training during draw holding.

A further object is to provide an archery trainer which develops smooth pull through with correct muscles.

Yet one more object is to provide an archery trainer which reduces target float when aiming.

Another object is to provide an archery trainer which can be used with state of the art archery string releasers to simulate actual bow muscle use.

Still another object is to provide an archery trainer with a pin for target panic avoidance training.

Another object is to provide an archer trainer to practice smooth arrow release.

One other object is to provide an archery trainer with a grip which promotes correct hand to grip training and practice.

Accordingly, one embodiment of the invention provides an archery trainer having a gripping handle, preferably generally rectangular in cross section, having an exterior grip pad medially disposed on the gripping handle which can lend a contour, such as a slight curve therein, for receiving the hand of the archer to simulate the portion of the bow gripped by the archer. A relatively inelastic member, such as a predetermined length archery string is connected to the gripping handle having its ends extending through a back side of gripping handle to a front side of the gripping handle at points above and below the grip pad and secured on the front side leaving a remaining loop portion on a back side. A force resistance elastic member, such as a bungee cord, connects at one end to the loop portion. Another end of the elastic member connects to a string attachment, such as another archery string loop, to permit connection to an archery release attachment. These form collective resistance components thus simulate the resistance in the bow.

A sight is provided extending from a top surface of the gripping handle. The sight includes a rod having a first portion extending upward from and coaxially aligned with a central axis of the gripping handle, a second portion extending at an angle relatively normal, e.g., perpendicular, and forward with respect to the first portion and can include a terminal end extending at an angle relatively normal, e.g., perpendicular, and upward from the second portion to provide a sight. This position simulates the location of a sight on an actual bow.

A bottom surface of the gripping handle is equipped with a weight attachment to enable connection of a weight. In this regard, the weight amount can be varied as a function of the user's strength, operably connected to the attachment.

In operation, the string is attached with a hook of the archery release mechanism gripped by the archer's wrist and hand to draw the collective resistance components such that the string attachment is under one's chin so that the hollow formed by the base of the index finger and the thumb fits snugly over and under the chin as a solid fixed anchor. It is thought important that this anchor be placed on the chin in the same place every time to achieve shot consistency.

By utilizing the archery trainer, one can practice the proper bow hand position necessary for accurate shooting. The archer also can practice how to draw a bow back properly using the archer's back muscles can be set in a correct and most efficient manner. Furthermore, the archer is able to get the feeling of the archery position while sighting over the sighting rod and is able to practice holding that position steady for an extended period of time necessary to properly sight on and hit a target.

Furthermore, the archer can practice the steps in shooting from the position of the hand on the bow to the draw of the archery string, the aim, and the hold. All of these steps are easily practiced without shooting of an actual bow. Drawing the collective resistance components back in combination with using a desired weight on the bottom of the gripping handle strengthens the arm, back and shoulder muscles which are required for proper and accurate shooting and the device can be used as an exerciser for that purpose.

There is thus provided a combined archery trainer and exercise device which has the objects of improving one's ability to properly aim at a target and strengthening the muscles required for proper and accurate archery. By use of this invention, one learns and practices all the phases of modern archery which requires diligence and constant practice to establish good archery form. One also performs the exercise necessary to develop and strengthen the arm, back and shoulder muscles without which the bow cannot be held steady on the target. The archer is thus able to shoot with less strain and is more relaxed in order to get a good score.

These and other objects and features of the invention will become clear to those skilled in the art from consideration of the following detailed description of a preferred embodiment of the invention when taken in conjunction with the accompanying drawings.

DETAILED DESCRIPTION OF THE PREFERRED EMBODIMENTS

Figure 3:
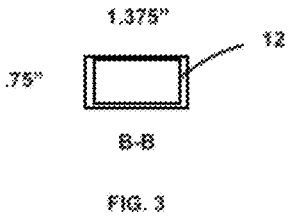
FIG. 3 is a sectional view through line through line B-B of FIG. 1.
Figure 1:
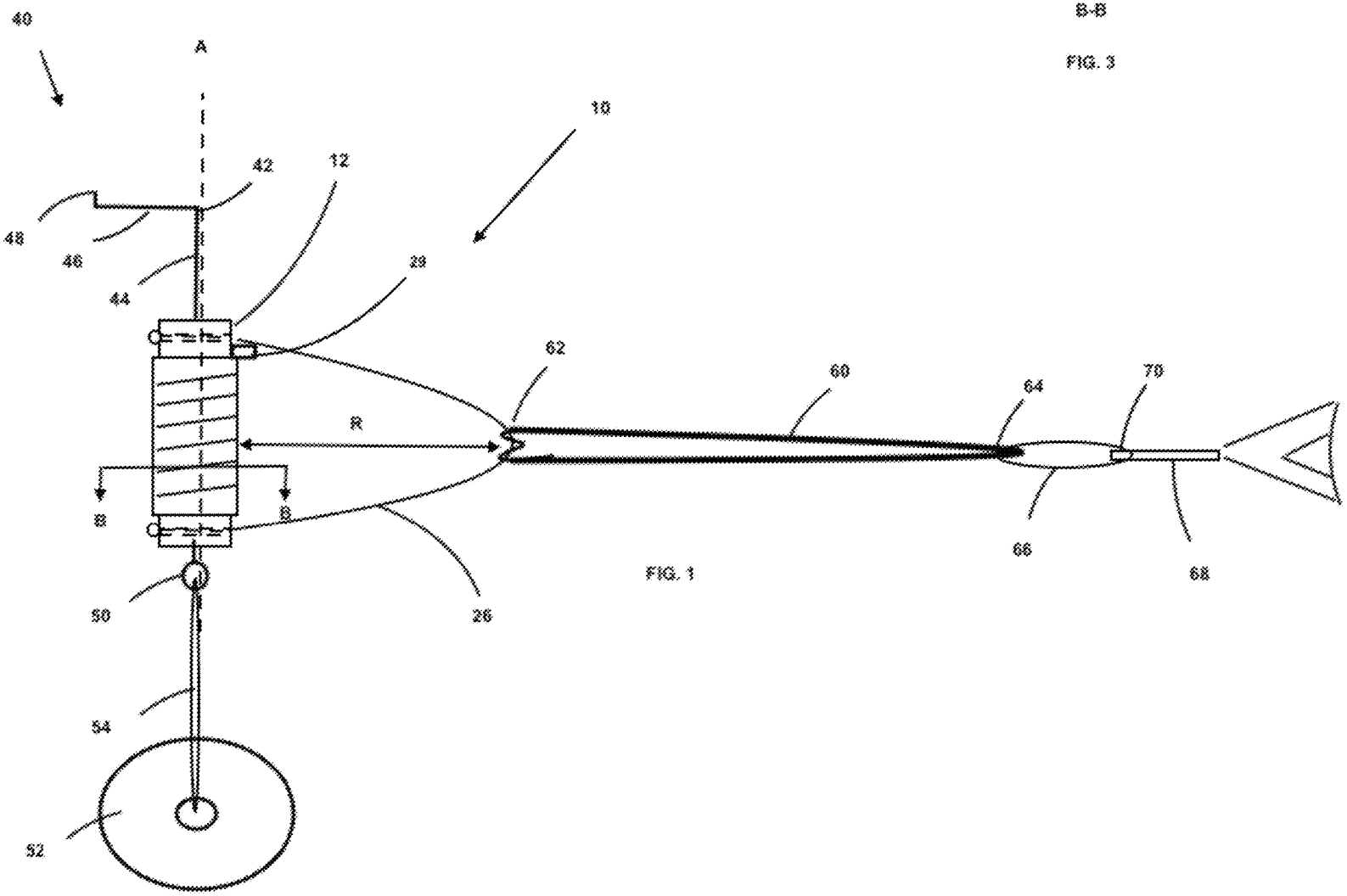
FIG. 1 is a view of the archery trainer and exercise device of the invention.
Figure 2:
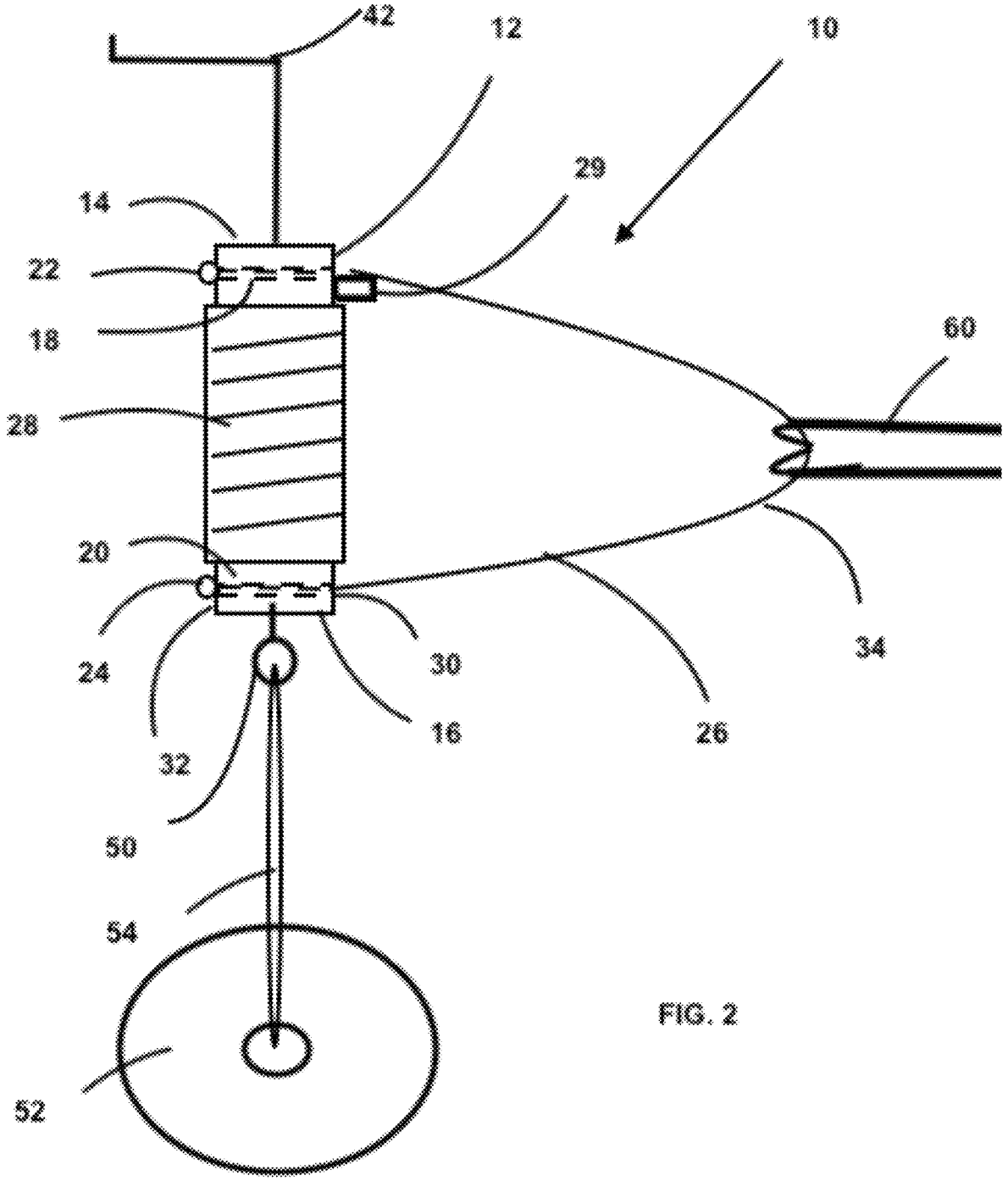
FIG. 2 is a view of a gripping handle of the instant invention.

Referring now to the drawings, an archery trainer and exercise device of the instant invention is generally designated by the numeral 10. The archery trainer and exercise device 10 has a gripping handle 12 which is seen in the detailed FIG. 2. The gripping handle 12 can be made preferably from a rigid material such as wood, metal or plastic and is generally rectangular in cross section to simulate the shape of a conventional bow handle. The gripping handle 12 is of a length wider than a width of a hand, for example, about 5.5 inch long and has a cross-sectional dimension through line B-B of about ¾ inch by 1 and ⅜ inch. Approximately ½ inch from a top surface 14 and bottom surface 16 inward there are axially formed through holes 18 and 20, respectively, which are large enough in diameter to receive respective ends 22 and 24 of a first archery string 26 (inelastic member). The ends 22 and 24 can be formed into a knot thereby preventing the archery string from being removed from the gripping handle 12. The first archery string 26 can be of a length of about 12 inches, for example, which once connected to the gripping handle 12 as described herein after provides a remaining loop portion 34 of about 10 inches in length or about 5 inches in its radius R as seen in FIG. 1. This first archery string 26 is useful in the invention as providing space for the bow hand of the archer when using the device 10.

The gripping handle 12 can have an exterior grip 28, such as a leather wrap or handle wrap tape, medially disposed on the gripping handle 12 which can lend a contour, such as a slight curve therein, for receiving one's hand to simulate the portion of the bow gripped by the archer. Additionally, there can be provided a grip pad 29 can be attached by a suitable means such as glue, for example, for restricting hand movement. The relatively inelastic member 26 can be a predetermined length archery string which is connected to the gripping handle 12 having its ends 22, 24 extending through a back side 30 of gripping handle 12 to a front side 32 of the gripping handle 12 at points above and below the grip 28 and secured on the front side 32 leaving the remaining loop portion 34 on a back side 30.

A sight 40 is provided extending from the top surface 14 of the gripping handle 12. The sight 40 includes a rod 42 having a first portion 44 extending upward from and coaxially aligned with a central axis A of the gripping handle 12. A second portion 46 extends at an angle relatively normal, e.g., perpendicular, and forward with respect to the first portion 44 and can include a terminal end 48 extending at an angle relatively normal, e.g., perpendicular, and upward from the second portion 46 to provide a sight. The forward extending terminal end 48 is helpful in assuming the archer is holding the gripping handle 12 correctly when viewing the sight 40. For example, with the terminal end 48 so disposed, a slight turn in the gripping handle 12 will greatly move the sight 40 of the target. The terminal end 48 can be painted with a bright color for sighting practice, such as red or yellow. The device 10 can then be used for sighting practice and target panic avoidance.

A bottom surface 16 of the gripping handle 12 is equipped with a weight connector 50, such as a hook or eyelet hook, to enable connection of a weight 52. The weight amount can be varied for strength training and operably connected to the weight attachment 50 by a string 54 for example. Increased weight amount provides for muscle development of the correct muscle groups for archery.

Figure 4:
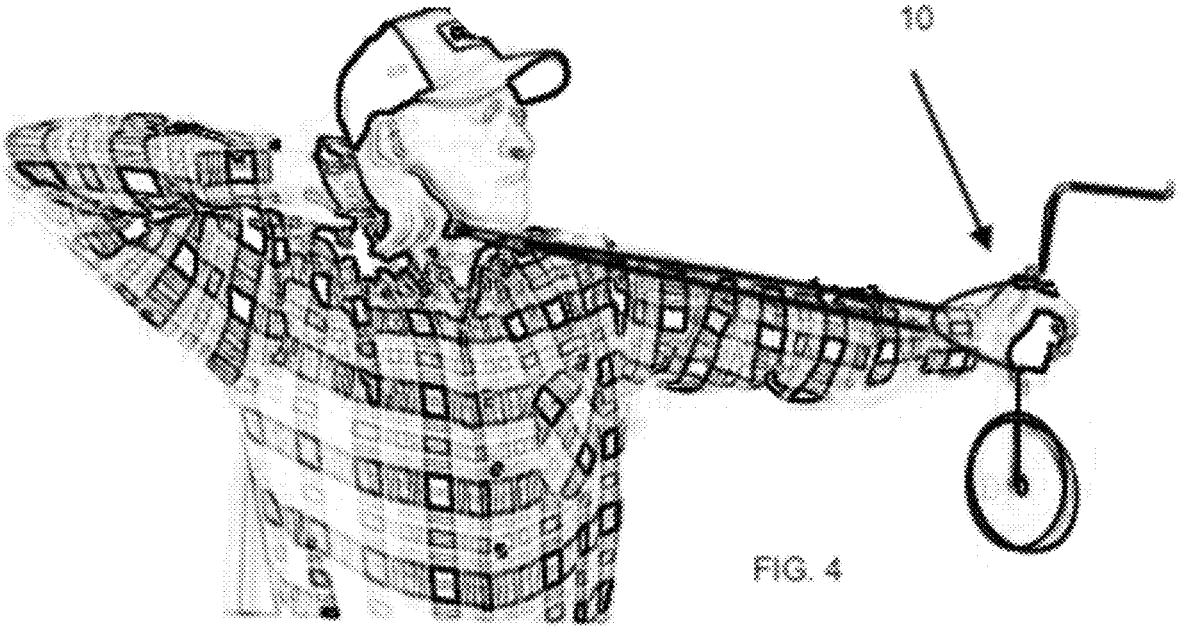
FIG. 4 is a representation of an archer utilizing the archery trainer and exercise device of the invention to practice proper hand position and sighting.

A force resistance elastic member 60, such as a bungee cord, connects at end 62 here shown with hooks, to the loop portion 34. Another end 64 of the elastic member 60 connects to a string attachment 66, such as another archery string loop, to permit connection to an archery release attachment 68. The string attachment 66 can be varied in size to accommodate the draw length L of the archer as seen in FIG. 4. In this regard, the components including the elastic member 60, string attachment 66, inelastic member 26 can form collective resistance components thus simulating resistance the bow. By way of example, an 18" stretch cord works well, however, a 24" cord doubled up, or a cord with more resistive force provides increased tension. These components can be varied to achieve a desired tension.

In operation, the string attachment 66 is grasped with a hook 70 of the archery release attachment 72. The archer's hand, wrist, arm shoulder and back draw the collective resistance components such that the string attachment 66 is under one's chin so that the hollow formed by the base of the index finger and the thumb fits snugly over and under the chin as a solid fixed anchor. It is thought important that this anchor be placed on the chin in the same place every time.

The correct position of the bow arm is assumed with the hand gripped lightly over the grip 28 of the of the gripping handle 12. After the correct position has been set, the sighting rod is aimed at a target.

The device 10 enables exercise of necessary for drawing and holding of the string of a bow. The push-pull draw movement uses appropriate common stretch cord folded to create the pull weight and/or hold weight desired for strength training. The collective components can be lengthened or shortened to achieve an archer's draw length which is a function of the physical structure. When the elastic member 60 is fully pulled a "wall" stop position is felt. This position is desirable for holding practice of a compound bow shooter.

By utilizing the archery trainer and exercise device 10, one learns the proper bow hand position necessary for accurate shooting. The archer also learns how to draw a bow back properly such that the archer's back muscles can be set in a correct and most efficient manner. Furthermore, the archer is able to get the feeling of the archery position while floating the sight 40 over the target to reduce float.

The archer learns the steps in shooting from the position of the hand on the bow to the draw of the archery string, the aim, and the hold. All of these steps are easily learned without shooting of an actual bow. Drawing the collective resistance components back in combination with using a desired weight on the bottom of the gripping handle strengthens the arms, back and shoulder muscles which are required for proper and accurate shooting and the device can be used as an exerciser for that purpose.

There, is thus provided a combined archery trainer and exercise device 10 which has the objects of improving one's ability to properly aim at a target and strengthening the muscles required for proper and accurate archery. By use of this invention, one can duplicate and practice the processes of modern archery which requires diligence and constant practice to establish good archery form. One also performs the exercise necessary to develop and strengthen the arms, back and shoulder muscles necessary to reduce bow float on the target. The archer is thus able to shoot with less strain and is more relaxed in order to hit the target.

To do the exercise, the collective components are drawn back and the shoulders are forced back so that the shoulder blades almost touch each other. This position is held for a period. By bringing the holding arm forward but still holding on to the string, one can relax and take the tension off these components. This can be repeated many times during a week to strengthen muscles. By repeating these exercises, an archer obtains the feeling for and proper position for holding and sighting and obtains training in maintaining steadier sight on target, all of which are essential when shooting a bow and arrow. Furthermore, the archery trainer and exercise device also strengthens the arms, back and shoulder muscles required for pulling the archery string back and releasing it for the proper archery technique.

What has been described is a single presently preferred embodiment of the invention. It will be readily apparent to those skilled in the art that various changes and modifications can be made which still remain within the spirit and scope of the invention as set forth in the appended claims.

What is claimed is:

1. An archery trainer and exercise device, which includes:

a gripping handle having a central grip surface in between a top end and a bottom end;

a relatively inelastic member connected to said gripping handle having a first end connected to said top end and a second end connected to said bottom end leaving a remaining loop portion interconnecting said first end and said second end; and a force resistance elastic member connected at one end to said loop portion and another end of said elastic member connected to a string attachment, to permit connection to an archery release attachment.

2. The archery trainer and exercise device of claim 1, wherein said relatively inelastic member is a length of archery string.

3. The archery trainer and exercise device of claim 1, wherein said force resistance elastic member is a length of bungee cord.

4. The archery trainer and exercise device of claim 1, wherein said string attachment is a length of archery string.

5. The archery trainer and exercise device of claim 2, wherein said archery string is connected to said gripping handle having ends of the archery string extending through a back side of said gripping handle to a front side of said gripping handle at points above and below said central grip surface and secured on said front side leaving said remaining loop portion on said back side.

6. The archery trainer and exercise device of claim 1, wherein said central grip surface includes a pad for restraining hand grip movement.

7. The archery trainer and exercise device of claim 1, wherein said gripping handle has a generally rectangular cross section.

8. The archery trainer and exercise device of claim 1, which includes a sight extending from a top surface of the gripping handle, wherein said sight includes a rod having a first portion extending upward from and aligned with a central axis of said gripping handle, a second portion extending at an angle relatively normal and forward with respect to said first portion and a terminal end extending at an angle relatively normal and upward from said second portion to provide a sight.

9. The archery trainer and exercise device of claim 1, wherein said bottom end is equipped with a weight connector to enable connection of a weight.

10. The archery trainer and exercise device of claim 8, wherein said terminal end is painted a color.

11. An archery trainer and exercise device, which includes:

a gripping handle having a central grip surface in between a top end and a bottom end; and a sight extending from a top surface of the gripping handle, wherein said sight includes a rod having a first portion extending upward from the top surface and coaxially aligned with a central axis extending through the top end and bottom end of said gripping handle, a second portion extending from an end of the first portion at an angle relatively normal and forward with respect to said first portion and a terminal end extending from an end of the second portion at an angle relatively normal and upward from said second portion to provide the sight.

12. The archery trainer and exercise device of claim 11, wherein said terminal end is painted a color.

13. The archery trainer and exercise device of claim 11, wherein said bottom end is equipped with a weight connector to enable connection of a weight.

14. The archery trainer and exercise device of claim 13, which includes a weight attached to said weight connector.

15. The archery trainer and exercise device of claim 11, which includes a relatively inelastic member connected to the gripping handle having a remaining loop portion on a back side of said handle, a force resistance elastic member connected at one end to the loop portion.

16. The archery trainer and exercise device of claim 15, which includes a string attachment connected at another end of said force resistance elastic member.

* * * * *